United States Patent [19]

Savoca et al.

[11] 4,278,876

[45] Jul. 14, 1981

[54] THERMOSTATICALLY CONTROLLED HEATER

[76] Inventors: Paul F. Savoca, 66 The Helm, East Islip, N.Y. 11740; Melvin Lindner, 387 Plymouth St., West Hempstead, N.Y. 11552

[21] Appl. No.: 71,728

[22] Filed: Aug. 31, 1979

[51] Int. Cl.[3] ..... H05B 3/58

[52] U.S. Cl. ..... 219/535; 219/50; 219/348; 219/356; 219/530; 219/536; 165/169; 338/316

[58] Field of Search ..... 219/50, 13 G, 137 R, 219/336, 352, 450, 510, 516, 530, 535, 536, 540, 542, 355, 356, 531, 537, 549; 165/169; 338/210, 316

[56] References Cited

U.S. PATENT DOCUMENTS

| | | | |
|---|---|---|---|
| 2,668,896 | 2/1954 | Husaczka et al. | 219/537 |
| 2,809,265 | 10/1957 | Jackson | 219/535 |
| 2,875,312 | 2/1959 | Norton | 219/535 |
| 2,877,332 | 3/1959 | Senior, Jr. | 219/536 |
| 2,992,314 | 7/1959 | Drudmand et al. | 219/535 |
| 3,045,098 | 7/1962 | Norton | 219/535 |
| 3,047,704 | 7/1962 | Van Noy et al. | 219/524 X |
| 3,191,003 | 6/1965 | Yohe | 219/450 |
| 3,207,887 | 9/1965 | Drugmand et al. | 219/535 |
| 3,272,968 | 9/1966 | Volker | 219/535 |
| 3,444,357 | 5/1969 | Drugmand | 219/535 |
| 3,691,347 | 9/1972 | Finn et al. | 219/535 |
| 3,749,881 | 7/1973 | Tanaka | 219/352 |

FOREIGN PATENT DOCUMENTS

| | | | |
|---|---|---|---|
| 2613908 | 10/1976 | Fed. Rep. of Germany | 219/535 |

*Primary Examiner*—Volodymyr Y. Mayewsky

[57] ABSTRACT

A thermostatically controlled heater for heating metal work pieces to within a selected temperature range prior to and during a welding process is disclosed. The heater comprises an electric heating element thermally connected to a heat conductive shoe and electrically connected to a source of electric power via a thermostat assembly. The thermostat assembly includes a heat conductive housing mounted on the heat conductive shoe in intimate thermal contact. The housing contains a thermostat having a thermal sensing area in thermal contact with an area of the heat conductive housing for regulating the amount of electricity conducted to the electric heating element. Accurate control of the temperature of the workpiece is accomplished by constructing the heat conductive housing so that the temperature gradient between the shoe and the thermostat matches the temperature gradient between the shoe and the workpiece itself.

5 Claims, 4 Drawing Figures

THERMOSTATICALLY CONTROLLED HEATER

BACKGROUND OF THE INVENTION

When welding together the edges of large steel plates to form ship hulls, American Society of Mechanical Engineers Code regulations require that the marginal portions of these plates be continuously heated to a temperature of between 200 and 300 degrees Farenheit prior to, during, and after the process of welding them together. Such heating prior to and during the welding process minimizes the temperature differential in the plates as the welding process is carried out, which in turn minimizes misalignment, warping, buckling or distortion between the plates being welded. Such heating after the welding process is completed serves to minimize distortion in the plates as they cool, thus reducing the amount of internal stress in and around the weld joint. The overall effect of the heating is to produce a stronger, deeper weld joint between steel plates which may be as much as six inches thick.

In the past, this heating process has been effectuated by strip heaters such as those disclosed in Senior U.S. Pat. No. 2,877,332, Norton U.S. Pat. No. 3,045,098, Van Noy, et al. U.S. Pat. No. 3,047,704, Drugmand et al. U.S. Pat. No. 3,207,887, Volker U.S. Pat. No. 3,272,968, Drugmand U.S. Pat. No. 3,444,357 and Tanaka U.S. Pat. No. 3,749,881. A plurality of such strip heaters are typically mounted in tandem along the marginal areas of the plates to be welded. Each of the heaters is then connected to a source of electric current, and in turn heats the marginal plate section abutting it.

Since the heater elements of many strip heaters operate at temperatures of 1000 degrees Farenheit or more, the steady state temperature condition of the plate sections abutting the heaters can attain values well in excess of the 300 degree Farenheit maximum limit set by the ASME Code, despite the large amount of heat conducted away from the marginal plate sections by the thick body of the plate. To avoid this overheated condition, human operators are employed to continuously monitor the temprature of the marginal plate sections with Tempilstik® or other temperature indicating means, and to continuously cut off and on the supply of electric power to heaters on the verge of overheating or underheating their respective workpieces.

The prior art solution to the problem of maintaining the temperatures of the marginal portions of thick steel plates to within a given temperature range is both expensive and inaccurate. It necessitates the employment of large amounts of unskilled labor to work twenty four hours a day, seven days a week to maintain the marginal plate sections to within the desired temperature ranges. Further, as the work is boring and repetitive, there is ample opportunity for a laborer to overlook a critical temperature reading and to let a portion of a workpiece attain an overheated or underheated condition which in turn detracts from the quality of the resulting weld joint. Moreover, considerable amounts of electrical energy are wasted whenever the error is on the side of an overheated condition, as the heater elements of each heater typically consume power at the rate of 2000 to 3000 watts.

Although automatic temperature controls for welding pre-heaters are generally known in the prior art, none of these controls is suitable for accurately and conveniently maintaining the temperature of the marginal areas of large steel plates one to six inches in thickness to within the limits required by the ASME Code. For example, while Bates U.S. Pat. No. 2,276,643 and Smith U.S. Pat. No. 2,184,534 both disclose automatic temperature controls in systems satisfactory for preheating and annealing objects such as plumbing pipes, the thermocouple sensing means utilized in each of these temperature controls is entirely unsatisfactory for use in a ship plate heater for at least three reasons. First, the thermocouple heat sensors used in these systems must be laboriously affixed to the workpiece itself, which is time consuming and labor expensive, and impedes the portability of the heater units. Second, the relatively delicate thermocouples and their connector lines can be easily damaged in the rough physical environment characteristic of shipyards. Thirdly, because of the broad temperature gradient between the 1000 degree Farenheit heater element and the marginal and adjacent portions of the one to six inch thick steel plate being heated, the thermocouples must be placed in exactly the right position on the marginal plate section or an erroneous temperature reading could result, which in turn would result in inaccurate functioning of the control.

Clearly the prior art has failed to provide a satisfactory temperature control for strip heaters used to heat thick steel plates to within a given temperature attendant to a welding process. Ideally, such a temperature control should be simply and conveniently attachable to prior art strip heaters. Moreover, such a control should not impede the portability of the strip by utilizing heat sensing elements which must be specially imbedded into the workpiece before use. Further, the control should be both sturdy and weatherproof and able to operate under rough shipyard conditions. Finally, such a control should be capable of consistently and accurately maintaining the temperature of the marginal plate section to within a given range, and should be capable of being inexpensively mass produced.

SUMMARY OF THE INVENTION

The invention provides a thermostatically controlled strip heater including a thermostatic control assembly which is conveniently attachable onto a strip heater having a thermally conductive shoe, and which accurately and effectively maintains the temperature of the workpiece to within a preselected range without the use of thermocouple heat sensors which must be imbedded within the workpiece. The thermostatic control assembly comprises a heat conductive housing including a front face having a flange adapted to be mechanically connected to the thermally conductive shoe of the strip heater in intimate thermal contact. The housing contains a bi-metallic thermostat thermally connected to an area on the front face of the housing, and electrically connected between the electrical heating element of the strip heater and the source of electricity powering it. Accurate control of temperature of the workpiece is accomplished by constructing the heat conductive housing of the thermostat so that the heat gradient between the shoe and the thermostat matches the heat gradient between the shoe and the workpiece. Thus, the thermostat indirectly senses the temperature of the workpiece by sensing the temperature of the thermally conductive shoe through the thermostat assembly housing, and control the amount of electric power entering the electrical heating element accordingly.

The invention may include one or more heat conducting ribs mechanically and thermally connected between the flange of the thermostat housing and the thermal sensing area on the housing. This rib serves the dual function of reinforcing the mechanical strength of the connection between the shoe and the housing, while adjusting the heat gradient between the flange and the thermal sensing area to better match the heat gradient between the shoe and the workpiece, thereby increasing the accuracy of the thermostatic control assembly.

Finally, the thermostatic assembly housing is of heavy construction and watertight to withstand mechanical shocks and prevent the entrance of water from rain, snow, or accidental immersion from entering into the thermostat.

DETAILED DESCRIPTION OF THE PREFERRED EMBODIMENT OF THE INVENTION

Figure 1:
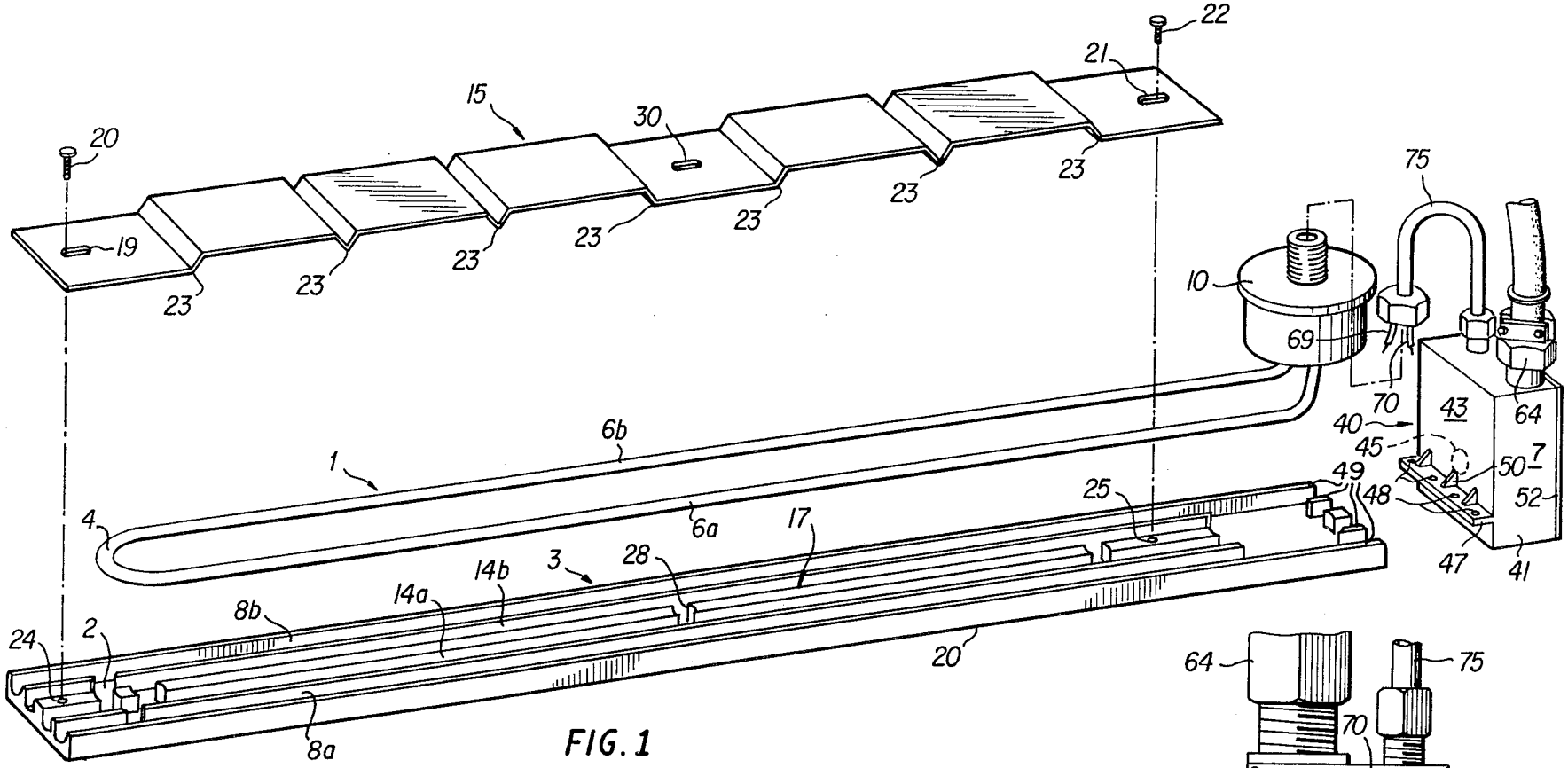
FIG. 1 is an exploded perspective view of the preferred embodiment of the invention.
Figure 2:
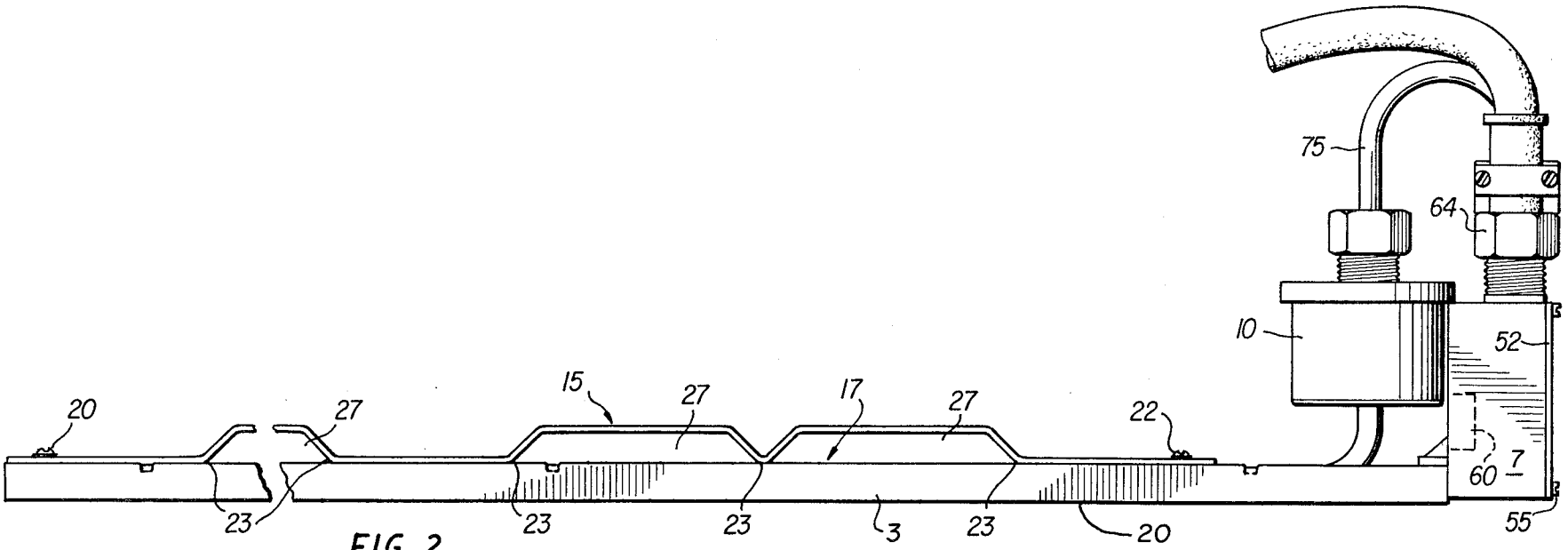
FIG. 2 is a side elevation of the preferred embodiment of the invention.
Figure 3:
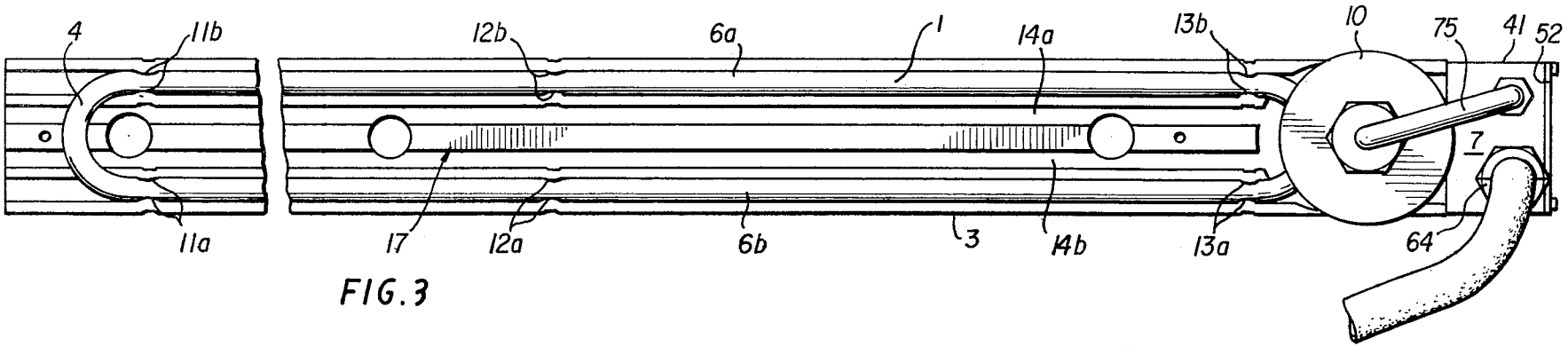
FIG. 3 is a top plan view of the preferred embodiment of the invention with the reflector plate removed.

With reference to FIGS. 1–3, the invention generally comprises a hairpin shaped electric heating element 1, an elongated, heat conductive thermal shoe 3, a reflective cover plate 15, and a thermostat assembly 7 thermally and mechanically attached to one end of the heat conductive shoe 3.

With specific reference to FIG. 1, the hairpin shaped heating element 1 is of a well-known type formed from a tubular metallic sheath containing a resistor-conductor embedded in refractory material. The heating element 1 includes a bight portion 4, and two parallel legs 6*a* and 6*b* which are mechanically and electrically connected to cylindrical connector member 10. Each of the legs 6*a* and 6*b* of the heating element 1 is preferably from 30 to 36 inches in length. Further, the electrical power capacity of heating element 1 is preferably between 2,000 and 3,000 watts.

The elongated, heat conductive thermal shoe 3 includes an arcuate groove 2 and two parallel linear grooves 8*a* and 8*b* for receiving the bight portion and the parallel legs 6*a* and 6*b* of the electric heating element, respectively. The heat conductive theremal shoe is preferably formed from aluminum for three reasons. First, aluminum possesses a high coefficient of thermal conductivity relative to other inexpensive metals, such as steel. Second, aluminum is quite ductile, which allows any thermally conductive shoe fabricated therefrom to be easily bent to conform to steel plates having an arcuate or otherwise non-linear profile. The shoe's ability to be bent becomes even more pronounced after heating element 1 has been energized, since aluminum becomes even more ductile when heated. Thirdly, the use of aluminum provides an inexpensive, easily fabricated, and substantially weatherproof thermally conductive shoe, each of which is important from both a commercial and practical aspect.

In addition to grooves 8*a* and 8*b*, the heat conductive shoe 3 also contains grooves 14*a* and 14*b* which advantageously reduce the shoe's resistance to a shear force applied thereon, thereby enhancing the ability of shoe 3 to conform to an arcuate or otherwise non-linear plate surface. Finally, shoe 3 includes a flat bottom surface 20 for evenly transferring the heat generated by electric heating element 1.

With reference now to FIGS. 1 and 3, electric heating element 1 is placed in intimate thermal contact with thermal shoe 3 by inserting bight portion 4 and parallel legs 6*a* and 6*b* of the electric heating element 1 into grooves 2, 8*a* and 8*b* of the thermal shoe 3, respectively, as shown. Each of the grooves 8*a* and 8*b* preferably includes at least three pairs of retaining flanges 11*a*, 12*a*, 13*a*, and 11*b*, 12*b*, 13*b* which retain the parallel legs 6*a* and 6*b* of electric heating element 1 in grooves 8*a* and 8*b* of thermal shoe 3 in intimate thermal contact therewith.

With reference now to FIGS. 1 and 2, the preferred embodiment also includes a reflective cover plate 15 which serves two functions. First, reflective cover plate 15 prevents excessive heat loss out of the upper fact 18 of thermally conductive shoe 3 by reflecting the heat back toward the shoe 3. Second, the plate 15 cooperates with flanges 11*a*, 12*a*, 13*a*, 11*b*, 12*b*, and 13*b*, to securely retain electric heating element 1 within heat conductive shoe 3. Specifically, reflective cover plate 15 retain the element 1 below the upper surface 17 of the shoe 3, within the grooves to 8*a*, and 8*b*, when it is mounted onto the upper surface 17 of shoe 3 by means of a pair of screws 20, 22. Screws 20, 22 are inserted through elongated screw mount apertures 19, 21, in cover plate 15 and screwed into screw holes 24, 25 to mount plate 15 into the position illustrated in FIG. 2.

Reflective cover plate 15 also includes a plurality of corrugations 23. These corrugations 23 cooperate with the axial "play" afforded by elongated screw mount apertures 19 and 20 to impart flexibility to the reflective cover plate 15 along its longitudinal axis. Thus reflective cover plate 15 may easily bend along with thermal shoe 3 whenever shoe 3 is bent to conform to an arcuate or otherwise non-planar plate surface. Corrugations 23 also serve the important purpose of providing a plurality of uniformly thick air spaces 27 between the bottom of plate 15 and the top surface 17 of thermal shoe 3 which greatly enhances the thermal insulating capacity of the cover plate 15. When the cover plate 15 and thermal shoe 3 are bent, it should be noted that the uniform thickness of each of the air spaces 27 is preserved both by the play afforded by elongated apertures 19 and 20 in cooperation with the support given to each of the individual sections of the plate 15 suspended between the corrugations 23.

Reflective cover plate 15 also includes an elongated aperture 30 which registers with a complementary aperture 28 in thermal shoe 3 when reflective plate 15 is secured onto the upper surface of thermal shoe 3. Elongated aperture 30 provides a means for mounting a bracket (not shown) for securing the entire heating unit onto a portion of the steel plate to be preheated. Like thermal shoe 3, reflective cover plate 15 is preferably formed from aluminum.

With reference now to FIG. 1, thermostat assembly 40 generally comprises a heat conductive thermostat housing 41. Thermostat housing 41 includes a heat conductive front face 43 which is preferably constructed from 14 gauge aluminum. Front face 43 in turn includes both a thermal sensing area 45, as well as a mounting flange 47 which orthogonally juts out along the bottom portion of front face 43 as shown. Mounting flange 47 is preferably fabricated out of aluminum, further includes a plurality of bolt holes 48 which register with complementary holes 49 in the thermal shoe 3 when the right angle surface formed between the bottom of mounting flange 47 and the bottom portion of front face 43 is abutted against the end of thermal shoe 3 in the position illustrated in FIG. 2. Mounting flange 47 preferably includes one or more thermally conductive reinforcing ribs 50 which thermally and mechanically connect the upper surface of flange 47 to a portion of the thermal sensing area 45 on face 43 of thermostat assembly housing 41. Such thermally conductive reinforcing ribs 50 serve the dual function of both strengthening the mechanical connection between housing 41 and thermal shoe 3 and balancing the heat gradient between thermal shoe 3 and thermal sensing area 45 to match the heat gradient between thermal shoe 3 and a workpiece (not shown) after a thermal steady state condition has been attained. The balancing of the heat gradient between thermal shoe 3 and thermal sensing area 45 and thermal shoe 3 and a workpiece increases the accuracy of the thermostat 60 contained within thermostat assembly 41, thereby advantageously providing more accurate thermostatic control of the preheater unit.

Figure 4:
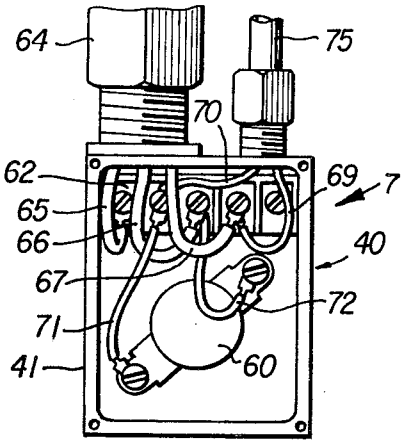
FIG. 4 is a back plan view of the thermostat assembly of the preferred embodiment of the invention with the back plate of the thermostat housing removed.

With reference now to FIGS. 1 and 4, thermostat housing 41 contains a thermostat 60 and a heat resistant terminal bar 62 which is preferably made out of a high temperature plastic material. Electric current is introduced into housing 41 by means of electric connector assembly 64 which introduces a ground wire 65 and two current wires 66, 67 into the interior of housing 41. Ground wire 65 is connected onto a ground terminal in terminal block 62 which in turn is electrically connected to the housing 41 and thermal shoe 3. Current wire 67 is directly connected to one of the wires 69 which leads directly to the electric heating element 1 via connector 10 as shown. The remaining electric element wire 70 is connected to current wire 66 through thermostat control wires 71, 72. Thus thermostat 60 controls the flow of current from current wires 66, 67 to electric heating element wires 69 and 70.

In the preferred embodiment, the thermostat 60 is a Thermodisc Corporation type number 60T21 pre-set to close the circuit between the current wires 66, 67 and the electric heating element wires 69, 70 when the thermostat 60 senses minimum temperature somewhere above the 200 degree F minimum limit, and pre-set to open the circuit when the thermostat 60 senses a maximum temperature, somewhere below the 300 degree F maximum limit. The exact settings may vary between various embodiments of the invention, depending on how accurately the heat gradient between the shoe 3 and thermostat 60 matches the heat gradient between the shoe 3 and workpiece. The use of a pre-set thermostat is preferred over an adjustable thermostat because the use of the latter type would necessitate the construction of a water tight access port in thermostat housin 41 to provide access for the thermostatic adjustment control. Such an access port would, of course, increase the expense of the unit, as well as provide an additional source of potential water leakage.

Thermostat housing 40 also includes a back plate 52 which is bolted onto the back of thermostat housing 41 in water tight relation therewith by means of bolts 55. Finally, thermostat housing 40 includes a "u" shaped conduit assembly 75 for both protecting and mechanically mounting electric heating element wires, 69, 70 onto the threaded portion of connector 10 as indicated in FIG. 1 in a water tight relationship. Like back plate 52, conduit assembly 75 is also mounted in water tight relationship onto thermostat housing 41. Further, connector assembly 64 is also mounted onto thermostat housing 41 in water tight relationship. These water tight connections render the thermostatically controlled heater not only weatherproof, but water submersible as well.

It will be apparent to those skilled in the art that the embodiment herein described may be variously changed and modified without departing from the spirit of the invention, and that the invention is capable of uses and has advantages not herein specifically described. Hence it will be appreciated that the herein disclosed embodiment is illustrative only, and that our invention is not limited thereto.

Having described our invention in such full, clear, concise, and exact terms as to enable any person skilled in the art to make and use the same, we claim:

1. A thermostatically controlled heater that can be seated on a plate-like metal workpiece that is to be welded, for heating the workpiece to within a selected temperature range prior to the welding process and for maintaining it in that temperature range, comprising:

(a) an elongate electrical resistance heating element of rod-like structure that is electrically connected to a source of electric power through a thermostat assembly that is disposed to control the power applied to said electrical resistence heating element;

(b) a heat conductive thermal shoe having a recessed portion in its upper surface, said heating element having a major portion thereof disposed in said recess in thermal contact with said shoe, said shoe having a lower face that forms a heat transfer surface for transferring the heat generated by said heating element to a workpiece on which the heater is seated with its lower face confronting and engaged against the surface of the workpiece;

(c) a reflective plate disposed over the upper surface of said shoe, covering said recess and the portion of the heating element disposed therein, said reflecting plate retaining said heating element in said recess; and (d) a thermostat assembly that is thermally and mechanically connected to said shoe, including a heat conductive housing, a mounting means for thermally and mechanically connecting said heat conducting housing to said shoe at one end of said shoe and in spaced relation to the nearest part of said electrical resistance heating element, and a thermostat temperature sensing element mounted within said housing and electrically connected between said electric resistance heating element and said source of electric power, for controlling the electric power that is applied to said electrical resistance heating element, said thermostat having said thermal sensing means disposed with and thermally connected to a portion of said heat conductive housing at which the heat gradient between said portion of the housing and sai thermal shoe substantially matches the heat gradient between said shoe and said workpiece, whereby said thermostat can be used to maintain the temperature of said workpiece within a selected temperature range by sensing the temperature of said shoe through said housing.

2. A thermostatically controlled heater in accordance with claim 1 wherein the said heat conductive housing of said thermostat assembly includes a heat conductive wall portion disposed generally at a right angle to the lower face of said shoe, said thermal sensing means being thermally connected to a thermal sensing area on said front wall, and wherein said mounting means thermally and mechanically connecting said heat conducting housing to said shoe includes a flange member projecting from the said front wall of said housing, said flange being positioned to overlie upper surface portions of said shoe, and mechanical fastening means securing said flange to the underlying portions of the upper face of the shoe, said fastening means being thermally conductive and securing the flange to the shoe in thermally conductive contact.

3. The heater of claim 1 or 2 wherein said shoe can be adjusted in shape so as to conform to the shape of a workpiece that is to be heated by engagement of the lower face of the heater shoe to an underlying surface of the workpiece and conformity of the lower face of the shoe to the shape of the surface of the workpiece.

4. The heater of claim 2 wherein said thermostat assembly includes a plurality of thermally conductive ribs that are spaced from each other and that are integral with and that structurally interconnect the said front wall of the housing and said flange.

5. The heater of claim 2 wherein the heat conductive housing of said thermostat assembly is water tight, to prevent the entrance of moisture within said housing.

* * * * *